United States Patent [19]

Locke

[11] Patent Number: 4,694,621

[45] Date of Patent: Sep. 22, 1987

[54] MODULAR BUILDING CONNECTING MEANS

[76] Inventor: Reginald A. J. Locke, 184 Hooper St., San Francisco, Calif. 94107

[21] Appl. No.: 669,154

[22] Filed: Nov. 7, 1984

[51] Int. Cl.[4] ..... E04B 1/41

[52] U.S. Cl. ..... 52/79.13; 52/125.6; 52/227; 52/726; 403/147

[58] Field of Search ..... 52/125.6, 125.2, 83, 52/227, 79.13, 726; 403/147, 195, 368, 334

[56] References Cited

U.S. PATENT DOCUMENTS

| | | | |
|---|---|---|---|
| 537,491 | 4/1895 | Smith | 403/147 |
| 1,012,423 | 12/1911 | Orr | 52/227 |
| 1,188,485 | 6/1916 | Pruyn | 52/726 |
| 1,786,631 | 12/1930 | Roe | 52/726 |
| 3,758,998 | 9/1973 | Ollis et al. | 52/79.13 |
| 3,782,061 | 1/1974 | Minutoli et al. | 52/227 |
| 3,999,355 | 12/1976 | Stucky | 52/79.13 |
| 4,081,936 | 4/1978 | Wise | 52/726 |

FOREIGN PATENT DOCUMENTS

| | | | |
|---|---|---|---|
| 633997 | 11/1978 | U.S.S.R. | 52/726 |

*Primary Examiner*—William F. Pate, III
*Assistant Examiner*—Caroline D. Dennison
*Attorney, Agent, or Firm*—Townsend and Townsend

[57] ABSTRACT

A system for constructing buildings utilizing a conical connector to fasten rods connecting structural members of a building. The conical connector is a rigid, solid device, circular in section, with an axial bore. The connector has a flat top surface and bottom surface perpendicular to the bore, a ring-shaped flange midway between the top surface and the bottom surface, and a sloping surface between the top surface and the flange and between the bottom surface and the flange wherein the circumference of the connector as defined by the sloping surface increases as the flange is approached, forming a cone. The sloped surface of the connector engages a recess in a structural member of the building. A tensioning mechanism passing through the bore in the connector applies a coupling force to hold the connector against the structural member. A multiple cone connector for joining adjacent modules of a building may be formed by joining the flanges of at least two connectors to form a single continuous flange.

15 Claims, 6 Drawing Figures

MODULAR BUILDING CONNECTING MEANS

BACKGROUND OF THE INVENTION

This invention relates to a modular building connecting system.

In conventional high-rise buildings, construction tolerances are strict because the construction and placement of components of each story depend upon the shape and position of the various portions of the immediately preceding story. Field measurements are continuously required, especially for the interior structures which must rely upon actual finished, as built, conditions for their installation. Modifications to hold specified construction tolerances are usually designed into the connecting system for the skeleton of a building. For example, bolted connections in steel construction have oversized or slotted holes to accommodate dimensional errors by adjusting the placement of a nut and bolt.

Computer analysis of the design of a building is often done to predict how the building will respond to external forces, such as earthquakes, so the building design can be modified to reduce the effect of such forces. Movements in a conventional building are difficult to predict because the locations of bolted connections can vary to give a virtually infinite number of combinations. Thus computer analysis is difficult because the values for friction and stress cannot be accurately established.

Modular buildings, such as those disclosed in U.S. Pat. No. 3,758,998, issued to Ollis et al., and U.S. Pat. No. 3,925,679, issued to Berman et al., provide for the construction of the various stories of a multi-story structure at a factory and its assembly at the site. Because the fit of each story can be tested at the factory, less in-field measurements are required and changes are more conveniently implemented.

A connecting system for a concrete building utilizing a string of tensioned rods is shown in U.S. Pat. No. 3,782,061 issued to Minutoli and Locke. A string of aligned rods pass through conduits in concrete building panels and are connected by nuts. The present invention provides an improved connecting system which is particularly suitable for modular steel buildings.

SUMMARY OF THE INVENTION

The present invention is a system for constructing buildings utilizing a conical connector to align rods connecting structural members of a building, sometimes referred to as the MODULOC system. The conical connector is a rigid, solid device, circular in section, with an axial bore. The connector has a flat top surface and bottom surface perpendicular to the bore, a ring-shaped flange midway between the top surface and the bottom surface, and a sloping surface between the top surface and the flange and between the bottom surface and the flange wherein the circumference of the connector as defined by the sloping surface increases as the flange is approached, giving a conical shape. The sloped surface of the connector precisely engages a recess in a structural member of the building. A tensioning mechanism passing through the bore in the connector applies a coupling force to hold the connector against the structural member.

In the preferred embodiment, the structural members of the building are steel modules. A number of tubes within each module are arranged vertically with rods running vertically through the tubes. The rods are connected by the connector, a washer and a coupler nut which has a threaded interior for engaging the threaded ends of two connecting rods, one of which also runs through the washer and the connector. Each tube has metal plates attached to its top and bottom through which the rods extend and each metal plate defines a recess for engaging one end of the connector.

This connecting system acts as a shock absorber for the building. The sloping surface of the connector serves to transmit lateral shear forces applied to the building into tensile forces along the vertical steel rod, thereby increasing the building's tolerance to external forces. The connector thus prevents shear forces from being applied to the vertical steel rods. The inclusion of a space between the recess in a structural member and the sloping surface of the connector near the flange enhances the transmission of shear forces into vertical tensile forces. The space allows the structural member to slide slightly sideways, and the sloped surface of the connector forces the structural member upward, thus changing the horizontal movement into vertical movement. The space also allows unimpeded horizontal movement and prevents sheer forces from being applied directly to the vertical rod.

The connector can be molded with a sintered powder metal process, thereby greatly reducing the production costs associated with machined parts. The sintered metal process allows the achievement of a variety of characteristics for the connector that would otherwise be difficult to achieve (e.g., corrosion resistant metals can be readily amalgamated).

For adjacent modules in a building, a double cone connector is used to provide a secure interconnection. The double cone connector essentially connects the flanges of two connectors to form a single flange which surrounds two conical protrusions on each side. The single flange provides continuity of lateral forces between modules by serving as the transmitter of such forces. Thus the tensile forces transmitted to the vertical steel rods in adjacent modules will be substantially the same, thereby virtually eliminating relative movements between modules. In some cases, 3, 4 or more connectors may be so combined, such as at the corner of several modules or at a corridor intersection in the building.

The invention also allows the prestressing of each story in a simple manner by adjusting the coupler nut as each story is erected to stress the rod extending through each such story with an erection tension sufficient to hold the modules together. Progressively, at certain intermediate stories, and particularly after the top story is added, the entire string of rods can be further tensioned to achieve the desired tensile value. This will cause the coupler nut adjacent each connector in the lower stories to be pulled up off its washer and 'float' due to further elongation of the string of rods. The string of rods thus effectively becomes a single rod with correspondingly better shock absorbing characteristics.

The tension at any connector can be specified in accordance with a computer analysis to effectively 'tune' the building to resist destructive harmonic vibrations. This is possible because the unique shape of the connector and the dimensional integrity with its mating parts in the structural members allows a precision of predictability of responses not possible with conventional building techniques.

The modular design enhances accurate computer analysis of the building. Because the invention combines a molded connector with modular stories which can be individually adjusted by the coupler nut in the field, strict construction tolerances are dispensed with and construction costs are accordingly reduced.

The dimensional integrity and predictable responses allowed by the MODULOC system make it ideally suited for complete design of structures by computer graphics.

DETAILED DESCRIPTION OF THE PREFERRED EMBODIMENT

Figure 1:
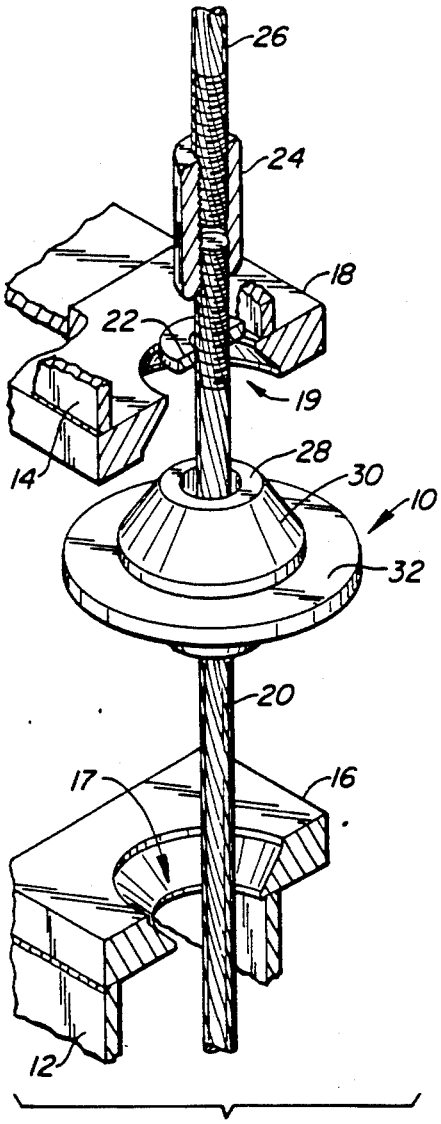
FIG. 1 is an exploded perspective view of the preferred embodiment of the connecting system for an intermediate story of a building.

As shown in FIG. 1, a conical connector 10 is attached between a tube 12 within a first module (not shown) and a tube 14 within a second module (not shown). At the end of tube 12 is attached a metal plate 16 which defines a recess 17 to engage one end of connector 10, and at the end of tube 14 is attached a metal plate 18 which defines a recess 19 to engage the other end of connector 10. A connecting steel rod 20 extends through tube 14 and connector 10 into tube 12. A washer 22 is placed so that the top end of rod 20 passes through washer 22 and washer 22 is flush with connector 10. A hexagonal coupler nut 24 is threaded onto the top end of rod 20 flush against washer 22. Coupler nut 24 can be tightened to apply a predetermined amount of stress to rod 20. After a second module (not shown) is placed on top of the first module (not shown), a second rod 26 is extended through tube 14 within the second module and is threaded into the upper end of coupler nut 24.

The top of connector 10 has a flat surface 28, a sloping surface 30 and a flange 32 around its center. The bottom of connector 10 is identical to the top. Lateral movement of the building causes a shearing force to be applied to the connector. Sloping surface 30 of the connector translates the shearing force into an axially directed expansion force which causes compression of tubes 12 and 14 and applied a tensile force to rods 20 and 26. Rods 20 and 26 are already highly tensioned and are able to absorb the tensile force.

Figure 2C:
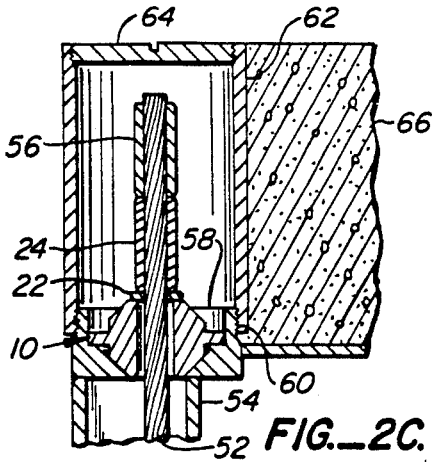
FIGS. 2A–C show fragmentary, sectional views of the preferred embodiment of the connecting system for the top story, and intermediate story, and the bottom story of a building, respectively.
Figure 2B:
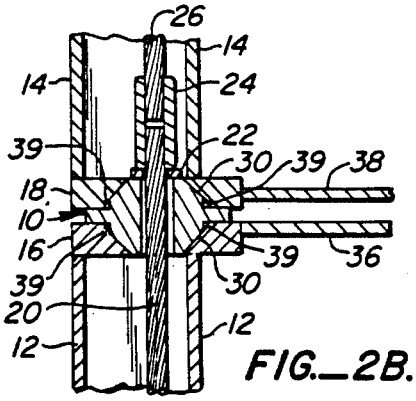

FIG. 2B shows a sectional view of connector 10 in place in an intermediate story of a building. Tubes 12 and 14 are connected to plates 16 and 18, respectively, which are in turn connected to connector 10.

Plate 16 is welded to tube 12 and is attached to a metal ceiling 36 of one module on one story of the building. Plate 18 is welded to tube 14 and is welded to a metal floor 38 which is the floor of a module on another story of the building.

After coupler nut 24 has been threaded onto rod 20 to apply tension sufficient for erection of the building, a module containing tube 14 and floor 38 is placed on top of the module containing tube 12 and ceiling 36. Rod 26 is then inserted into tube 14 and threadedly attached to coupler nut 24. The process is repeated for each succeeding story.

Progressively, at desired intermediate stories, and particularly after the story is added, the entire string of rods 20, 26 can be further tensioned to achieve a desired tensile value. Coupler nut 24 in each of the lower stories will be pulled up off washer 22 due to further elongation of rods 20, 26. Coupler nut 24 will thus "float," and the string of rods 20, 26 will effectively act as a single rod with better shock absorbing characteristics. This also virtually eliminates eccentric forces at coupler nut 24.

It can be seen that lateral shear forces will be transmitted through floor 38 and plate 18 to connector 10, and through ceiling 36 and plate 16 to connector 10. Connector 10 then transfers the shear forces into axial forces along the rod string including rods 20 and 26, as described earlier. A number of spaces 39 between plates 16, 18 and connector 10 allow some horizontal movement of plates 16 and 18 toward connector 10. This horizontal movement is translated into vertical movement by the interaction of the sloping surface 30 of connector 10 and the corresponding surfaces of plates 16, 18. This redirection of movement helps transfer shear forces into tensile forces along rods 20, 26.

Figure 2A:
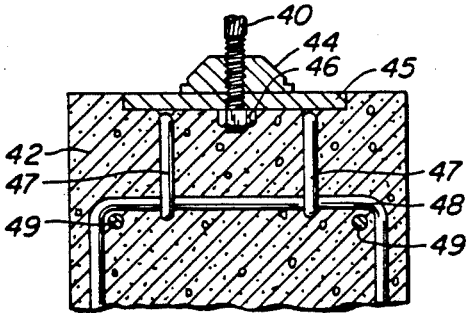

FIG. 2A shows the connection of a bottom connecting rod 40 to a foundation 42. Rod 40 extends from the bottom of the first story tube (not shown) and is threaded into an anchor cone 44. The upper end of anchor cone 44 is shaped to fit a recess in the plate (not shown) on the bottom of the first story tube in the manner shown in FIG. 1. Anchor cone 44 is welded to a continuous metal plate 45 which is long enough to anchor a number of anchor cones 44. Rod 40 may extend through plate 45 and be anchored by a nut 46. Plate 45 is welded to a pair of reinforcing bars 47. Reinforcing bars 47 loop through perpendicular reinforcing bars 48 between connections to plate 45. Additional reinforcing bars 47 loop through bars 48 to provide additional structural integrity.

FIG. 2C shows the connection of an uppermost steel rod 52 to the top of a tube 54 for the top story of a building. Connector 10, washer 22, and coupler nut 24 are present and connected in a manner shown in FIGS. 1 and 2B. A second coupler nut 56 is also threadedly attached to the end of rod 52. The upper end of connector 10 is engaged by a disc 58 which is held in place by a sleeve 60. Sleeve 60 is threadedly attached to a pipe sleeve 62, and a cap 64 is threadedly attached to the top of pipe sleeve 62. After adjustment of the tension of rod 52 with a calibrated ram applied to coupler nuts 24 and 56, pipe sleeve 62 and cap 64 are attached to enclose and protect the upper end of rod 52. The pipe sleeve 62 and cap 64 can then be encased or embedded in a concrete roof slab 66.

Figure 3:
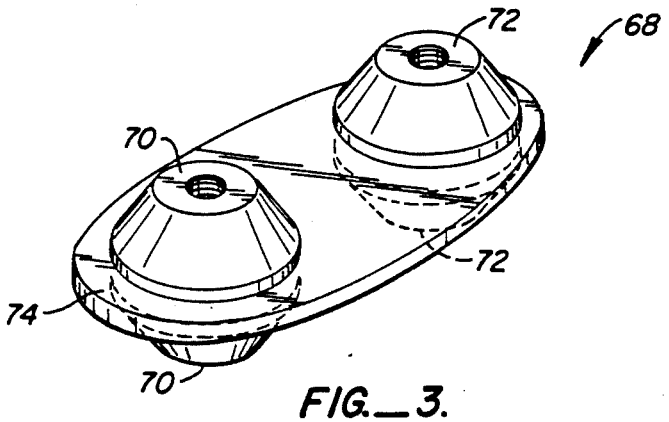
FIG. 3 is a perspective view of the preferred embodiment of a double cone connector.
Figure 4:
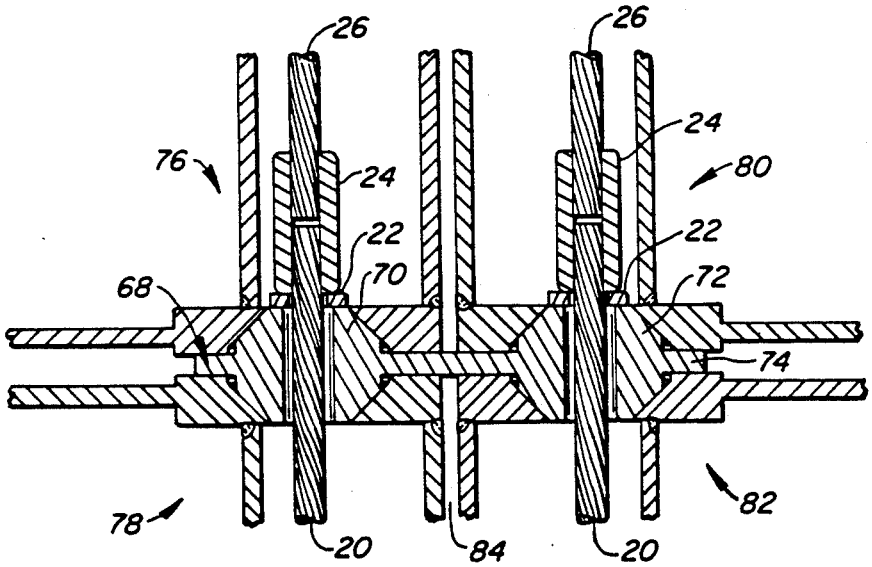
FIG. 4 is a sectional view of the preferred embodiment of the double cone connector in an intermediate story of a building.

Referring to FIGS. 3 and 4, the preferred embodiment of a double cone connector 68 is shown. Connector 68 has two conical portions 70 and 72 surrounded by a single flange 74. FIG. 4 shows connector 68 in place between adjacent modules 76, 78 on the left and 80, 82 on the right. The use of coupler nut 24, washer 22 and steel rods 20, 26 is the same as shown in FIG. 2B. A space 84 will exist between modules 76, 78 and modules 80, 82. It can be seen that flange 74 of connector 68 will transmit shear forces between modules 76, 78 and modules 80, 82. These shear forces will be transferred into tensile forces along rods 20, 26 so that substantially equal forces will be transferred by cones 70 and 72 of connector 68. Thus relative movement between modules 76, 78 and modules 80, 82 is greatly reduced.

Triple or 4 cone connectors can also be used for corner junctions of modules or at the edges of corridors, etc. Additional cones can be added by simply extending the flange so that effectively the flanges of several connectors are connected to form a single continuous flange.

The use of the connecting system of the present invention has many advantages, including the ability to easily add to or disassemble (rather than demolish) existing buildings using the connecting system of the present invention.

While the invention has been shown and described with reference to a preferred embodiment thereof, it will be understood by those skilled in the art that various changes in form and detail may be made therein without departing from the spirit and scope of the invention.

What is claimed is:

1. A steel building construction for fastening structural members of a steel building together comprising:

a plurality of rigid, solid connectors, circular in section, each with an axial bore, a flat top surface and bottom surface perpendicular to the bore, a ring-shaped flange midway between the top surface and the bottom surface, a first sloping surface extending from the top surface toward the flange, a second sloping surface extending from the bottom surface toward the flange, wherein the circumference of the connector as defined by the sloping surfaces increases as the flange is approached, a first vertical surface extending from said first sloping surface to said flange and a second vertical surface extending from said second sloping surface to said flange, said flange having an axial dimension less than a distance from said top surface to said flange;

a plurality of rods with a threaded first end and a threaded second end, the first end of each rod passing through the bore in a connector;

a plurality of coupler nuts, each located proximate to a connector and having a threaded through bore for receiving the first end of one rod and the second end of another rod; and a plurality of spaced structural members of a building, each structural member having a mating portion defining a recess within each of its ends shaped to couple with the portion of the connector extending outward from one of the surfaces of the flange, each said mating portion of said structural member having a sloped surface complementary to one of said connector sloped surfaces and a vertical surface joined to said mating portion sloped surface and complementary to one of said connector vertical surfaces and offset from said connector vertical surface such that a gap is defined so that said structural member sloped surface may slide along said connector sloped surface when subjected to a horizontal force, the structural members being aligned with each other, with a string of the rods extending through the structural members, coupler nuts and connectors.

2. The building construction of claim 1 wherein the structural members include tubes enclosing said rods.

3. The building construction of claim 1 further comprising a plurality of washers, through each of which passes a rod and each being located between a connector and a coupler nut.

4. The building construction of claim 2 wherein each tube is connected to a module of a modular building.

5. The building construction of claim 2 further comprising a second coupler nut threadedly attached to the first end of the rod extending through the top of the uppermost tube.

6. The building construction of claim 5 further comprising a pipe sleeve encasing the first end of the rod extending through the top of the uppermost tube and a cap threadedly attached to the top of the pipe sleeve.

7. The building construction of claim 1 wherein the coupler nuts are hexagonal nuts.

8. The building construction of claim 2 further comprising a foundation and an anchor cone threadedly attached to the end of the rod extending through the bottom of the lowermost tube and having an upward facing surface identical in shape to the upward half of a connector, the bottom end of said anchor cone being secured to the foundation.

9. The building construction of claim 8 wherein the foundation includes a recess and futher comprising a platform attached to the bottom of the anchor cone and a plurality of elongated members attaching the platform to the bottom of the recess in the foundation.

10. The building construction of claim 2 further comprising a plurality of metal plates, each metal plate attached to an end of a tube, and each metal plate defining one of the recesses in each tube.

11. The building construction of claim 10, further comprising a plurality of metal ceilings, each ceiling being attached to the top end of a tube and the metal plate at the top of such tube.

12. The building construction of claim 10 further comprising a plurality of metal floors, each floor being attached to the bottom end of a tube and the metal plate at the bottom of such tube.

13. The building construction of claim 1 wherein at least two said connectors are joined at their flanges in the same plane, with the joined flanges forming a single continuous flange.

14. A steel building construction for fastening structural members of a steel building together comprising:

a plurality of rigid, solid connectors, circular in section, each with an axial bore, a flat top surface and bottom surface perpendicular to the bore, a ring-shaped flange midway between the top surface and the bottom surface, a first sloping surface extending from the top surface toward the flange, a second sloping surface extending from the bottom surface toward the flange, wherein the circumference of the connector as defined by the slopping surfaces increases as the flange is approached, a first vertical surface extending from said first sloping surface to said flange and a second vertical surface extending from said second sloping surface to said flange, said flange having an axial dimension less than a distance from said top surface to said flange;

a plurality of rods with a first threaded end and a second threaded end, the first end passing through the bore in a connector;

a plurality of cylindrical hexagonal coupler nuts, each located proximate to a connector and having a threaded through bore for receiving the first end of one rod and the second end of another rod;

a plurality of wahsers, through each of which passes a rod and each being located between a connector and a coupler nut;

a plurality of spaced tubes, the tubes being aligned with each other, with a string of the rods extending through the tubes, coupler nuts, connectors and washers, and with each tube forming part of a building module;

a plurality of metal plates, each metal plate attached to an end of a tube, and each metal plate having a mating portion defining a recess shaped to couple with the portion of the connector extending outward from one of the surfaces of the flange, each said mating portion of said metal plate having a sloped surface complementary to one of said connector sloped surfaces and a vertical surface joined to said mating portion sloped surface and complementary to one of said connector vertical surfaces and offset from said connector vertical surface such that a gap is defined so that said metal plate sloped surface may slide along said connector sloped surface when subjected to a horizontal force, a second coupler nut threadedly attached to the first end of the rod extending through the top of the uppermost tube;

a pipe sleeve encasing the first end of the rod extending through the top of the uppermost tube and a cap threadedly attached to the top of the pipe sleeve;

a foundation with a recess;

an anchor cone threadedly attached to the end of the rod extending through the bottom of the lowermost tube and having an upward facing surface identical in shape to the upward half of a connector;

a platform attached to the bottom of the anchor cone;

a plurality of elongated members attaching the platform to the bottom of the recess in the foundation;

a plurality of metal ceilings, each ceiling forming part of a building module and being attached to the top end of a tube and the metal plate at the top of such tube; and a plurality of metal floors, each floor forming part of a building module and being attached to the bottom end of a tube and the metal plate at the bottom of such tube.

15. A steel building construction for fastening structural members of a steel building together comprising:

a plurality of rigid, solid connectors, circular in section, each with an axial bore, a flat top surface and bottom surface perpendicular to the bore, a ring-shaped flange midway between the top surface and the bottom surface, a first sloping surface extending from the top surface toward the flange, a second sloping surface extending from the bottom surface toward the flange, wherein the circumference of the connector as defined by the sloping surfaces increases as the flange is approached, a first vertical surface extending from said first sloping surface to said flange and a second vertical surface extending from said second sloping surface to said flange, said flange having an axial dimension less than a distance from said top surface to said flange, said sloping surface being at an angle of approximately 45° relative to said flange;

a plurality of rods with a threaded first end and a threaded second end, the first end of each rod passing through the bore in a connector;

a plurality of coupler nuts, each located proximate to a connector and having a threaded through bore for receiving the first end of one rod and the second end of another rod; and a plurality of spaced structural members of a building, each structural member having a mating portion defining a recess within each of its ends shaped to couple with the portion of the connector extending outward from one of the surfaces of the flange, each said mating portion of said structural member having a sloped surface complementary to one of said connector sloped surfaces and a vertical surface joined to said mating portion sloped surface and complementary to one of said connector vertical surfaces and offset from said connector vertical surface such that a gap is defined so that said structural member sloped surface may slide along said connector sloped surface when subjected to a horizontal force, the structural members being aligned with each other, with a string of the rods extending through the structural members, coupler nuts and connectors.

* * * * *